US005860525A

United States Patent [19]

Bellehchili

[11] Patent Number: 5,860,525

[45] Date of Patent: Jan. 19, 1999

[54] BAG FOR TRANSPORTING SUBSTANTIALLY RIGID ELONGATE LOADS

[76] Inventor: Djamal Bellehchili, 21, Rue du Depart, 75014 Paris, France

[21] Appl. No.: 786,854

[22] Filed: Jan. 22, 1997

[30] Foreign Application Priority Data

Jan. 22, 1996 [FR] France ..... 96 00679

[51] Int. Cl.[6] ..... B65D 71/00

[52] U.S. Cl. ..... 206/443; 206/174; 206/428; 383/18

[58] Field of Search ..... 206/139, 142, 206/162, 170, 174, 176, 180, 427, 428, 433, 443, 446; 383/12, 15, 16, 18, 21, 25, 29, 38

[56] References Cited

U.S. PATENT DOCUMENTS

| | | | |
|---|---|---|---|
| 919,745 | 4/1909 | McCraw | 383/29 |
| 1,418,403 | 6/1922 | Smith | 383/38 |
| 1,617,629 | 2/1927 | Glae | 206/139 |
| 1,951,604 | 3/1934 | Friedlander | 383/38 |
| 1,983,418 | 12/1934 | Thurmer | 383/38 |
| 2,089,297 | 8/1937 | Read et al. | 383/38 |
| 2,141,906 | 12/1938 | Friedlander | 383/25 |
| 2,473,429 | 6/1949 | Hinman | 206/162 |
| 2,596,533 | 5/1952 | Cottrel | 206/162 |
| 2,737,221 | 3/1956 | Knox | 383/29 |
| 4,210,186 | 7/1980 | Belenson | 383/18 |
| 4,428,484 | 1/1984 | Rattay et al. | 383/38 |
| 4,463,789 | 8/1984 | Leiserson | 383/16 |
| 4,542,826 | 9/1985 | Adams | 206/427 |
| 4,783,363 | 11/1988 | Hudson | 383/38 |
| 4,819,793 | 4/1989 | Willard et al. | 206/162 |
| 4,877,128 | 10/1989 | Strickland | 206/170 |
| 5,046,860 | 9/1991 | Brennan | 150/111 |

*Primary Examiner*—Jimmy G. Foster
*Attorney, Agent, or Firm*—Hill & Simpson

[57] ABSTRACT

A bag for transporting substantially rigid elongate loads including an envelope made of a deformable but non-stretchable material comprising a bottom, a peripheral wall and having an opening plane as well as a direction of insertion of the loads in the bag extending perpendicularly to the opening plate; and handles made of a deformable but non-stretchable material joined to the bag, the space delimited by the envelope being divided into at least two compartments by a partition wall made of a deformable but non-stretchable material, the function of the bag when it is in its position of use, in which it is held by the handles, being to fasten the loads positioned inside it so as to keep them in a fitted position.

7 Claims, 2 Drawing Sheets

FIG. 2a
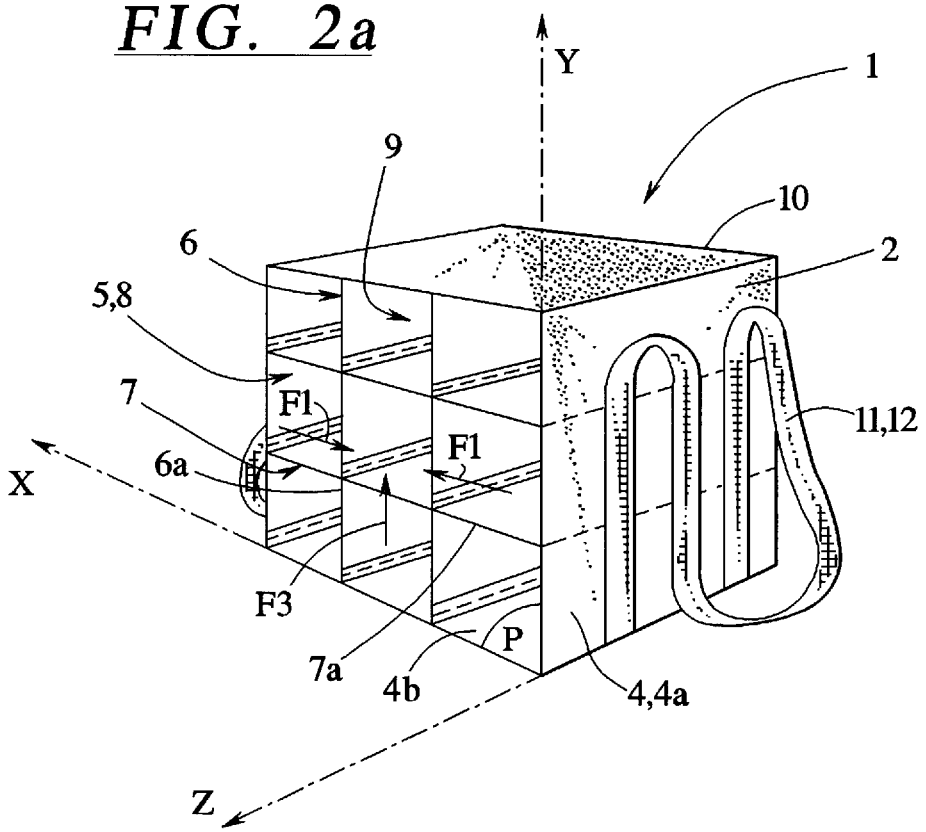
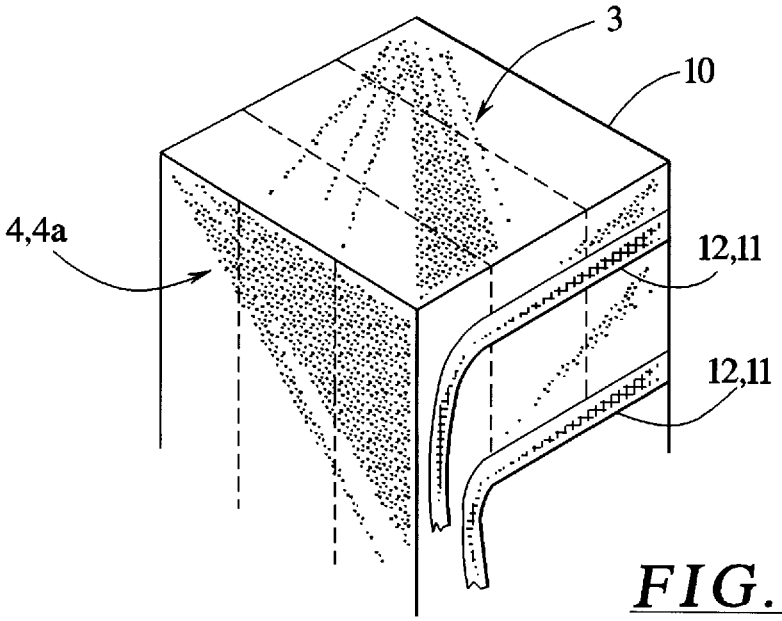
FIG. 2b

BAG FOR TRANSPORTING SUBSTANTIALLY RIGID ELONGATE LOADS

INCORPORATION BY REFERENCE OF FOREIGN PRIORITY APPLICATION

Priority French application Number 9600679, filed Jan. 22, 1996, is incorporated herein by reference to provide any disclosure mistranslated or omitted in translation.

BACKGROUND OF THE INVENTION

The invention relates to a bag intended to receive at least two substantially rigid loads, particularly with an elongated shape, such as bottles for example.

The invention applies more particularly to the transportation of bottles. Nevertheless, it also applies to any other type of load, as long as it is rigid and has an elongated shape, such as fruit juice, milk packages or similar, especially when a user goes shopping in supermarkets or department stores, or decides to purchase this type of load in large or small quantities.

Bottle cases including a rigid envelope comprising a bottom, an opening opposite to the bottom and a peripheral wall are known of. They further include partition walls defining compartments for the reception of bottles, these partition walls also being made of a rigid material. Due to their rigidity, these cases have the disadvantage of being difficult to transport when they are filled with bottles.

Furthermore, when these cases are only partially filled, the bottles must be distributed within the case so as to obtain a stable balance during transportation.

In addition, these cases can only be carried with the opening directed upwards, as otherwise there is a risk that the bottles will fall.

Finally, it is difficult to adapt these cases to different bottle sizes. Indeed, if the bottles have a width substantially inferior to that of the compartment, they may break during transportation as they are not correctly held in position.

Bags intended to receive loads such as food products, bottles, etc. are also known of which include an envelope comprising a bottom, a peripheral wall and an opening opposite to the bottom, as well as grasping means joined to the bag.

These bags are generally made of a reinforced material making it possible to withstand a large quantity of loads without breaking.

However, if the user wishes to transport loads having an elongated shape, this type of bag is not at all convenient since the loads are not held in position, neither vertically nor horizontally, and, as a result there is a risk that they will hit and therefore break each other. Furthermore, the structure of these bags does not make it possible to obtain a proper distribution of the loads.

This load distribution is all the worse when the load volume to be transported is smaller than the volume delimited by the envelope of the bag.

Furthermore, this type of bag does not allow for fast and easy loading and unloading.

SUMMARY OF THE INVENTION

An object of the invention is to eliminate the above-mentioned disadvantages.

For this purpose, the invention provides a bag of a type intended to receive loads having an elongated shape, and allowing for a proper distribution of these loads so that it is easy to transport and unload them.

An additional object of the invention is a bag making it possible to keep certain loads from being damaged while using the bag.

A final object of the invention is such a bag which can be used regardless of the size of the loads that it is intended to receive.

For this purpose, in an embodiment the invention provides a bag intended to receive at least two substantially rigid loads, particularly with an elongated shape, such as bottles for example, characterised in that it includes:

an envelope made of a deformable but non-stretchable material comprising a bottom, a peripheral wall, and an opening opposite to the bottom and having an opening plane defining a first and second opening directions as well as a direction of insertion of the loads in the bag extending perpendicularly to the opening plane; and grasping means made of a deformable but non-stretchable material joined to the bag, the space delimited by the envelope being divided into at least two compartments by at least one partition wall made of a deformable but non-stretchable material extending substantially parallel to the direction of insertion, and being intended to receive the loads so that they extend substantially parallel to the direction of insertion when they are in a fitted position, the function of the bag, when it is in its position of use, in which it is held by the grasping means, being to fasten the loads positioned inside it an as to keep them in a fitted position.

Thus, the partition wall makes it possible, like the case, to guide the insertion of the loads in the bag but, unlike the case, the loads are also kept fastened in a fitted position due to the deformable structure.

With this deformable structure, it is to no longer necessary to distribute the loads in the bag.

In order to keep the loads in a fitted position, in the position of use of the bag, the grasping means apply, on the loads, in combination with the peripheral wall of the envelope and the partition wall, on the one hand, a force along the second opening direction, and, on the other hand, a force along the direction of insertion.

This last function is obtained in the case where the grasping means consist, for example, of handles fixed to the exterior of the peripheral wall of the envelope, so that in the position of use of the bag they extend substantially parallel to the direction of insertion.

Moreover, according to another embodiment, it can be provided, in the position of use of the bag, for the grasping means to apply, on the loads, in combination with the peripheral wall of the envelope and the partition wall, on the one hand, a force along the first opening direction, and, on the other hand, a force along the second opening direction.

In this case, the grasping means consist of handles fixed to the exterior of the peripheral wall of the envelope, so that in the position of use of the bag they extend substantially perpendicularly to the direction of insertion.

In particular, regardless of the embodiment, the handles can consist of a single strap fixed at several points to the circumference of the outer face of the peripheral wall of the envelope.

When there are several partition walls, it can be provided for one of them to be movable, so as to create compartments of different sizes, adaptable to the various sizes of the loads.

Thus, according to one embodiment, the bag of the invention includes at least two partition walls substantially second with respect to one another and, it particular, perpendicular with respect to one another.

The envelope of the bag can also have a substantially rectangular parallelepiped shape.

Moreover, regardless of the shape of the envelope, it can be provided for the partition wall to extend parallel to the first opening direction on parallel to the second opening direction.

In the case where the bag includes several particles walls substantially secant with respect to one another at least one of these walls will be parallel to the first opening direction and the other perpendicular to this first opening direction.

Finally, according to one embodiment of the invention, the partition wall(s) is/are sewn on the envelope of the bag.

The invention will be described in greater detail below with reference to the attached drawings showing embodiments of the invention.

BRIEF DESCRIPTION OF THE DRAWINGS

FIG. 2*a* shows a perspective view of a second embodiment of a bag according to the invention; and FIG. 2*b* shows a perspective bottom view of the bag shown in FIG. 2*a.*

DETAILED DESCRIPTION OF THE PRESENTLY PREFERRED EMBODIMENTS

Figure 1A:
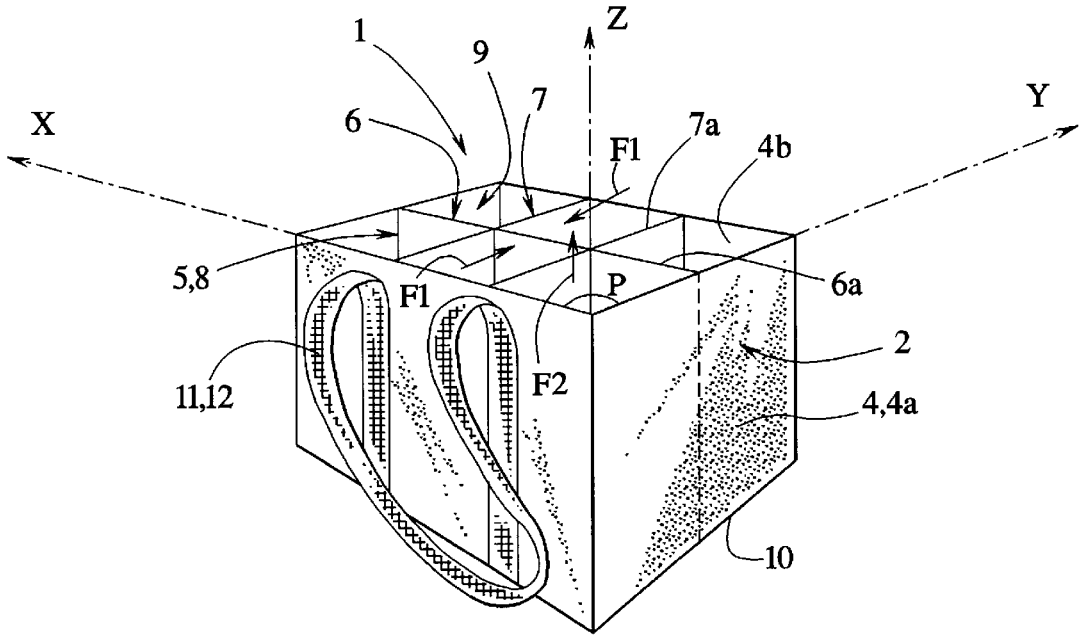
FIG. 1*a* shows a perspective view of a first embodiment of a bag according to the invention.
Figure 1B:
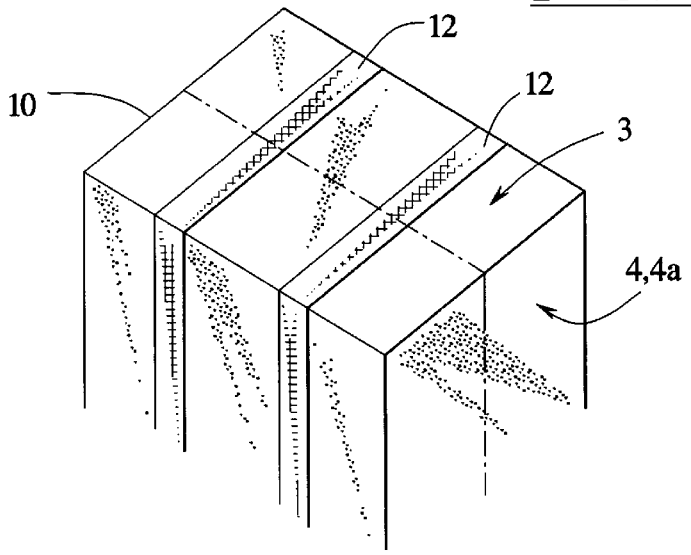
FIG. 1*b* shows a perspective bottom view of the bag shown in FIG. 1*a;*

The bag 1 according to the invention is intended to be used to transport loads having an elongated shape. In the example shown, the loads will be considered as being bottles.

Moreover, any type of elongated shape can be provided for, of course, such as, for example, parallelepiped packages consisting liquids or packages containing household products or similar.

The bag 1 includes as envelope 2 which, in the present case, has a parallelepiped shape, but which can, of course, have a different shape, even cylindrical.

This envelope 2 includes a bottom 3, a peripheral wall 4 and an opening 5, the whole being made of a deformable non-stretchable material.

The opening 5 has an opening pane P defining a first opening direction X and a second opening direction Y.

In addition, a direction of insertion 2 of the loads in the bag 1 is defined perpendicularly to the opening plane P.

The material used for the envelope 2 of the bag 1 is a deformable non-stretchable material, for example, a flexible plastic material making it possible, in particular, to fold the bag when it is not used so as to be easily put away, such as braided polyethylene, polypropylene, PVC or similar, for example.

According to the invention, the bag further includes partition walls 6 and 7 made of a deformable and non-stretchable material intended to divide the space 8 delimited by the envelope 2 into compartments 9 capable of receiving the bottles.

Thus, these partition walls 6, 7 extend parallel to the direction of insertion Z of the loads in the bag.

In the examples shown in FIGS. 1*a* and 2*a,* the bag includes two types of partition walls, i.e.:

a first type of partition walls 6 which, in addition, extend parallel to the first opening direction X; and a second type of partition walls 7 which, in addition, extend perpendicularly to this first opening direction X.

It is, of course, possible to provide as many partition walls of the first and/or second type as required and, in particular, to provide only one partition wall of the first type and/or only one partition wall of the second type.

As an example, in FIG. 1*a,* one wall 6 of the first type and two walls 7 of the second type have been provided, whereas in FIG. 2*a,* two walls 6 of the first type and two walls 7 of the second type have been provided.

These walls 6 and/or 7 thus make it possible to delimit compartments 9 for receiving the loads. In the examples shown, these compartments 9 all have the same dimensions. Moreover, it is, of course, possible to position the walls 6 and 7 so as to obtain compartments 9 of different sizes.

In the examples shown in the figures, the partition walls 6 and 7 are fixed to the envelope 2 on the inner face 4*a* of the peripheral wall 4. However, other types of fixing can be provided for, such as glue or adhesive fixing, or even movable fixing, such as "Velcro" (registered trademark) type fixing.

Indeed, the movable fixing of the partition walls 6 and 7 makes it possible to vary the compartmentation according to the size of the loads to be placed in the bag 1.

In the example shown in FIG. 1*a,* the partition walls 6 and 7 have a length equal to that of the side of the envelope which they are parallel to.

Moreover, it is possible to position partition wall section 6*a* to 7*a* as shown in FIG. 2, for example, these partition wall sections 6*a* and 7*a* being fixed to one another at the points of intersection i.

Again, the fixing can be achieved with "Velcro" (registered trademark), with an adhesive or by sewing.

The stitches are shown with dotted lines in all the figures.

In order to stiffen or strengthen the bag 1, a reinforcement can be provided on the bottom of the bag 1. Moreover, to allow for the bag to be foldable, this reinforcement 10 consists of a lining sewn on the peripheral edge of the bottom 3, on the exterior of the envelope 2.

The bag 1 further includes grasping means 11 joined to the bag 1 and also made of a deformable but non-stretchable material.

These grasping means 11 are, for example, handles fixed to the outer face 4*b* of the peripheral wall 4.

As shown in the figures, the handles consist of a single strap 12 fixed at several points to the circumference of the outer face 4*b* of the peripheral wall 4.

This fixing, shown with dotted lines, can consist of stitches, for example. But it an also consist of a hoop and loop fastener, a glue or an adhesive.

According to a first embodiment shown in FIG. 1*a,* in the position of use of the bag 1, the handles 11 extend parallel to the direction of insertion Z.

Herein, the term position of use refers to the position in which the bag 1 is held by the grasping means 11.

Thus, the fastening of the loads to be transported is obtained through the joint action of the handles 11, the peripheral wall 4 of the envelope 2, and the partition walls 6, 7, due to their deformable structure, which apply, together, on the one hand, a force substantially parallel to the second opening direction Y, as shown by the arrow F1, and, on the other hand, a force parallel to the direction of insertion Z, as shown by the arrow F2.

The loads are then fastened in their fitted position, which corresponds to the position in which they are placed in the compartments 9.

According to a second embodiment, the handles 11 extend substantially perpendicularly to the direction of insertion Z.

In this case, the opening 5 is no longer located at the top of the bag, but rather on one of its sides when the latter is used.

Moreover, the handles 11, the peripheral wall, as well as the partition walls 6, 7, due to their deformable structure, act jointly so as to apply, on the one hand, a force shown by the arrow F3 substantially parallel to the first opening direction X, and, on the other hand, a force F1 substantially parallel to the second opening direction Y, making it possible to keep the loads in a fitted position in the bag.

Even though the opening is located on one of the lateral sides of the bag, these forces keep the loads from coming out of the bag accidentally.

Finally, the deformable aspect of the assembly of elements making up the bag according to the invention makes it possible to obtain a stable balance of the bag, in both its position of use and other positions, even if it is not completely filled and if the loads are not distributed correctly.

Although modifications and changes may be suggested by those skilled in the art, it is the invention of the inventors to embody within the patent warranted hereon all changes and modifications as reasonably and properly come within the scope of their contribution to the art.

I claim:

1. A flexible bag for transporting rigid elongate objects and for securing the position of the elongate rigid objects within the bag during transport and handling, the bag comprising:

an envelope comprising at least one peripheral wall having a bottom end connected to a bottom wall and a top end defining an opening, the opening lying in an opening plane, the opening plane being parallel to the bottom wall, the objects being inserted into the bag along a direction of insertion that extends perpendicular to the opening plane and the bottom wall, the peripheral wall being connected to a first partition wall and a second partition wall, the first and second partition walls extending across the envelope perpendicular to each other, each of the first and second walls comprising opposing ends and a bottom edge, the opposing ends of the first and second walls being connected to the peripheral wall, the bottom edge of at least one of the first and second partition walls being connected to the bottom wall, the first and second partition walls being connected to each other at an intersection point thereof, the first and second partition walls extending from the top end of the partition wall to the bottom wall and parallel to the direction of insertion, peripheral wall being connected to a handle comprising an endless loop which extends downward from the top end of the peripheral wall to the bottom end of the peripheral wall at a first opposing side of the peripheral wall, across the bottom wall and upward from the bottom end of the peripheral wall to the top end of the peripheral wall at a second opposing side of the peripheral wall, the handle being connected the first and second opposing side of the peripheral wall and the bottom wall, the handle forming two straps disposed above the top end of the peripheral wall at the first and second opposing sides thereof, upward lifting force imposed on the two handles resulting in opposing inward forces imposed on the objects by the first and second opposing sides of the peripheral wall thereby securing the objects in place in the bag.

2. A bag according to claim 1, characterized in that the straps extend substantially parallel to the direction of insertion.

3. A flexible bag for transporting rigid elongate objects and for securing the position of the elongate rigid objects within the bag during transport and handling, the bag comprising:

an envelope comprising at least one peripheral wall having a closed end connected to an end wall and an open end defining an opening, the opening lying in an opening plane, the opening plane being parallel to the end wall, the objects being inserted into the bag along a direction of insertion that extends perpendicular to the opening plane and the end wall, the peripheral wall comprising four sides including opposing top and bottom sides disposed between two opposing sidewalls, the peripheral wall being connected to a first partition wall and a second partition wall, the first and second partition walls extending across the envelope perpendicular to each other, each of the first and second walls comprising opposing ends and a bottom edge, the opposing ends of the first and second walls being connected to the peripheral wall, the bottom edge of at least one of the first and second partition walls being connected to the end wall, the first and second partition walls being connected to each other at an intersection point thereof, the first and second partition walls extending from the open end of the partition wall to the end wall and parallel to the direction of insertion, peripheral wall being connected to a handle comprising an endless loop which extends around the two opposing sidewalls and across the bottom side of the peripheral walls, the handle being connected to both opposing sidewalls and the bottom side of the peripheral wall, the handle forming two straps disposed above the top end of the peripheral wall at the first and second opposing sides thereof, upward lifting force imposed on the two straps resulting in opposing inward forces imposed on the objects by the opposing sidewalls of the peripheral wall thereby securing the objects in place in the bag.

4. A bag according to any of claims 1 to 3, characterized in that the at least one partition wall is movable.

5. A bag according to any of claim 1 to 3, characterized in that it includes at least two partition walls substantially secant with respect to one another.

6. A bag according to claim any of claims 1 to 3, characterized in that the envelope has a substantially rectangular parallel piped shape.

7. A bag according to any of claims 1 to 3, characterized in that the at least one partition wall is sewn on the envelope.

* * * * *